US007959543B2

(12) United States Patent
Reyes

(10) Patent No.: US 7,959,543 B2
(45) Date of Patent: Jun. 14, 2011

(54) ISOLATED CURL MACHINE AND METHOD OF TRAINING THEREFOR

(75) Inventor: Gil Reyes, Las Vegas, NV (US)

(73) Assignee: GRAA Innovations, LLC, Las Vegas, NV (US)

( * ) Notice: Subject to any disclaimer, the term of this patent is extended or adjusted under 35 U.S.C. 154(b) by 0 days.

(21) Appl. No.: 12/383,636

(22) Filed: Mar. 25, 2009

(65) Prior Publication Data

US 2010/0248912 A1 Sep. 30, 2010

(51) Int. Cl.
*A63B 21/062* (2006.01)

(52) U.S. Cl. ..... 482/99; 482/131; 482/148

(58) Field of Classification Search ..... 482/93, 482/99–103, 133–138, 131, 148
See application file for complete search history.

(56) References Cited

U.S. PATENT DOCUMENTS

| | | | | | |
|---|---|---|---|---|---|
| 3,019,019 | A | * | 1/1962 | Forte | 482/94 |
| 4,239,210 | A | * | 12/1980 | Lambert, Jr. | 482/100 |
| 4,563,003 | A | * | 1/1986 | Bugallo et al. | 482/100 |
| 4,702,108 | A | * | 10/1987 | Amundsen et al. | 73/379.01 |
| 4,711,448 | A | * | 12/1987 | Minkow et al. | 482/100 |
| 4,911,435 | A | * | 3/1990 | Johns | 482/137 |
| 5,042,799 | A | | 8/1991 | Stanley | |
| 5,242,347 | A | * | 9/1993 | Keeton | 482/102 |
| 5,738,613 | A | * | 4/1998 | Clayton | 482/47 |
| 5,800,321 | A | * | 9/1998 | Webber | 482/103 |
| 5,964,685 | A | | 10/1999 | Boland | |
| 6,056,678 | A | * | 5/2000 | Giannelli et al. | 482/137 |
| 6,063,014 | A | | 5/2000 | Scoggins | |
| 6,409,637 | B1 | * | 6/2002 | Webber et al. | 482/99 |
| 7,563,207 | B1 | * | 7/2009 | Burek | 482/91 |

FOREIGN PATENT DOCUMENTS

| | | | |
|---|---|---|---|
| FR | 2623720 | A1 * | 6/1989 |
| FR | 2645738 | A1 * | 10/1990 |

* cited by examiner

*Primary Examiner* — Fenn C Mathew
(74) *Attorney, Agent, or Firm* — Weide & Miller, Ltd.

(57) ABSTRACT

An isolated curl machine and method therefor is disclosed herein. Generally, the isolated curl machine provides a resistance having a force which is directed upward and away from the user. The machine may also support the user's upper arms, or a portion thereof. In this manner, training on the machine is highly focused on the biceps. The machine may comprise a frame, a seat, an arm rest, and a resistance device. The user may engage the machine by sitting in the seat and placing his or her arms on the arm rest. In this position, the user may engage the resistance device such as by grasping a handle of the resistance device. The resistance device provides the resistance which resists movement of the user's arm during a bicep curl and may be configured such that the force of the provided resistance is directed upward and away from the user.

6 Claims, 3 Drawing Sheets

ISOLATED CURL MACHINE AND METHOD OF TRAINING THEREFOR

BACKGROUND OF THE INVENTION

1. Field of the Invention

The invention relates to exercise equipment and in particular to an isolated curl machine and method of training.

2. Related Art

Traditionally, bicep curls are performed by first grasping a weight or other resistance and lifting the weight by contracting the biceps. The contraction of the biceps causes the arm to bend at the elbow as the resistance is lifted. A bicep curl may be performed one arm at a time or on both arms simultaneously. Various techniques for performing bicep curls are known and commonly used such as the preacher curl and the concentration curl. These techniques rely on the lifting of a resistance to provide training to the biceps.

Traditional machines designed for bicep curl exercises, unlike free weights, may include a structure to limit the user's range of motion to that of a bicep curl. For example, traditional machines may provide a surface upon which the user may rest his or her upper arms so that the biceps are primarily used to lift a resistance. Traditionally, the hands are extended downward below the elbows when starting the exercise and then lift the resistance upward to a point higher than the elbows. In addition, some traditional machines include a rigid pivoting or rotating structure which may only be moved along an arc corresponding to the arc made by the user's arm lifting at the elbow. Though such machines may assist with proper bicep curl technique, training is not as effective as with the method and apparatus disclosed herein.

Thus, what is provided herein is a novel isolated curl machine and method of training.

SUMMARY OF THE INVENTION

An isolated curl machine for training the biceps is disclosed herein. In one embodiment, the machine comprises a frame, a seat configured to allow a user to sit thereon, an arm rest configured to support at least a portion of at least one of the user's upper arms. The seat may be secured at the front of the frame, and the arm rest may be secured above the seat and between the front and the back of the frame. The machine may include a resistance device configured to provide resistance, a cable having a first end and a second end and configured to transfer the resistance provided by the resistance device to the user, and a pulley configured to accept at least a portion of the cable to guide the first end of the cable toward the user. The resistance device may be secured at the back of the frame, and the pulley may be secured at the top of the frame or at a raised point at least above the arm rest at a raised point. The second end of the cable will generally be attached to the resistance device. A handle, which the user may grasp, may be attached to the first end of the cable.

Elements of the isolated curl machine may be configured in various ways. For example, the arm rest may be configured to support at least a portion of at least one of the user's upper arms substantially perpendicular from the user's torso. The height of the seat and the height of the arm rest may be adjustable. The resistance device may vary as well. In one embodiment, the resistance device comprises a weight stack. In another embodiment, the resistance device comprises a variable resistance device.

In another embodiment, the isolated curl machine comprises a frame, an arm rest configured to support at least a portion of at least one of the user's upper arms, and a user engageable resistance assembly configured to provide resistance to the user whereby the force of the provided resistance is directed upward and away from the user during a bicep curl. The resistance assembly may be secured at the back of the frame. The arm rest may be secured at the front of the frame and between the top and bottom of the frame. In addition, the arm rest may be configured to support at least a portion of the user's upper arms substantially perpendicular from the user's torso.

The resistance assembly may be configured such that the force of the resistance provided by the resistance assembly is directed upward and away from the user's biceps. Also, it is contemplated that the resistance assembly may be configured such that the force of the resistance provided by the resistance assembly is directed away from the user.

In one embodiment, the resistance assembly comprises a resistance device configured to provide resistance, a handle, a cable having a first end and a second end and configured to transfer the resistance provided by the resistance device to the user, and a pulley configured to guide the first end of the cable toward the user. The cable may be attached to the handle at the first end and attached to the resistance device at the second end. In this manner, the resistance assembly may be user engageable by the user grasping the handle.

A method of bicep training is also provided. In one embodiment, the method of bicep training comprises engaging an isolated curl machine. The isolated curl machine may comprise an arm rest configured to support at least a portion of at least one of the user's upper arms, a user engageable resistance assembly configured to provide resistance to the user whereby the force vector of the provided resistance is directed upward and away from the user, and a frame configured to support the arm rest and the resistance assembly.

According to the method, the user may then engage the resistance assembly by grasping a portion of the resistance assembly, and move at least one of the user's forearms from an initial position to an end position of a bicep curl to move the resistance provided by the resistance assembly. The user may then return his or her forearm(s) to the initial position of the bicep curl while engaged to the resistance assembly.

The user may engage the isolated curl machine in various ways. For example, the user may engage the isolated curl machine by placing at least a portion of at least one of the user's upper arms on the arm rest. This may occur such that the user's upper arm or arms are supported substantially perpendicular from the user's torso. In some embodiments, the isolated curl machine further comprises a seat to support the user's body. In these embodiments, the user may engage the isolated curl machine by sitting on the seat with at least one of the user's upper arms supported by the arm rest.

The resistance assembly may be configured in various ways. For example, the resistance assembly may comprise a resistance device configured to provide the resistance, a handle, a cable having a first end and a second end and configured to transfer the resistance provided by the resistance device to the user, and a pulley configured to guide the first end of the cable downward toward the user. The cable may be attached to the handle at its first end and attached to the resistance device at its second end. In this manner, the user may engage the resistance assembly by grasping the handle. It is noted that the resistance device may comprise a weight stack, or a variable resistance generator in one or more embodiments.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The isolated curl machine as disclosed herein allows a resistance to be moved and bicep training to be achieved generally by a downward pulling motion. This is in contrast to an upward pulling motion adopted by the prior art. As will be discussed further below, the isolated curl machine generally provides resistance from a raised point in front of the user whereby the user pulls downward toward the user to flex the biceps. In this manner, a user may pull towards his or her body during training. This focuses training on the biceps to a degree not achievable with traditional bicep curls.

Figure 1:
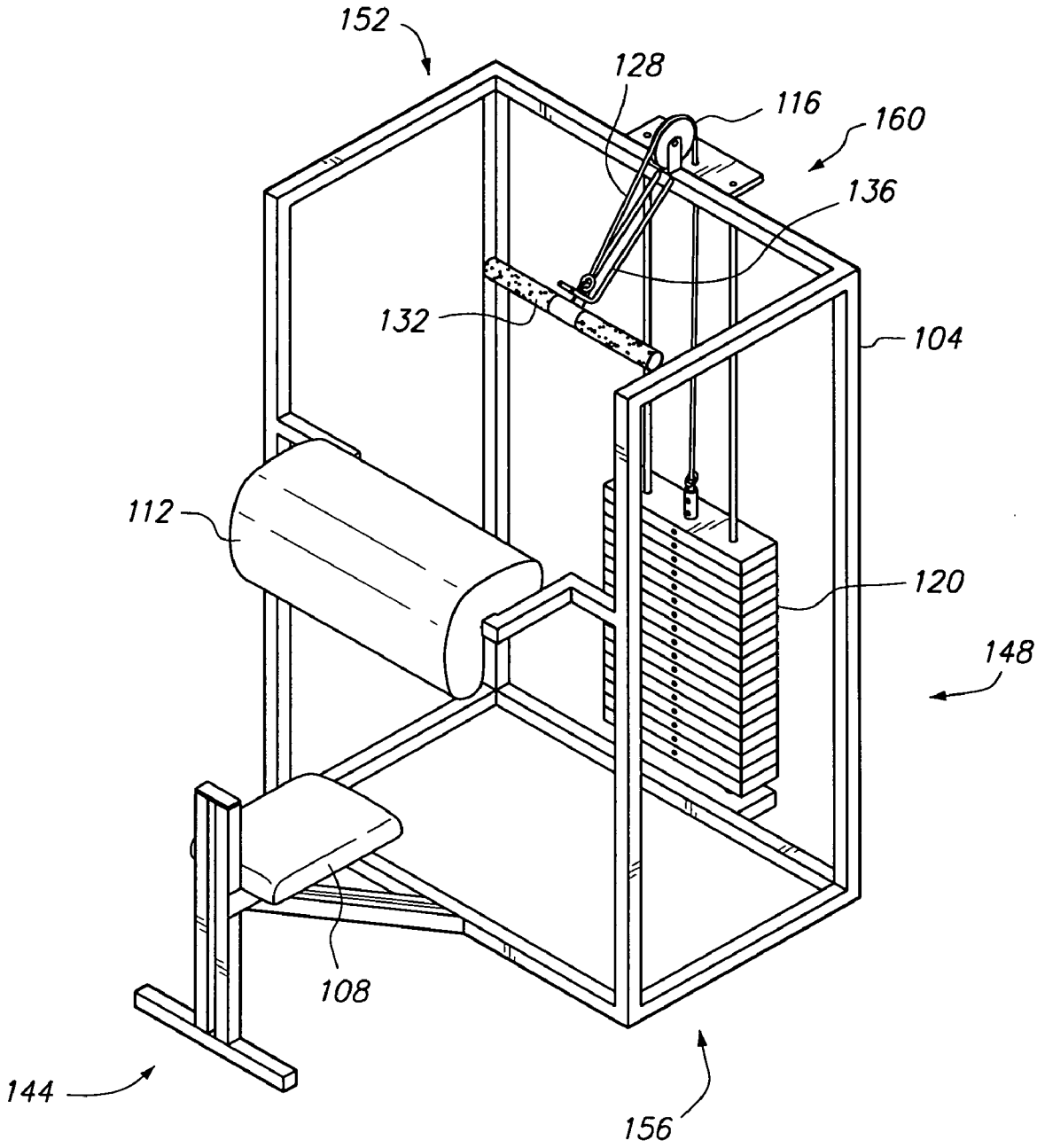
FIG. 1 is a perspective view of an exemplary embodiment of the isolated curl machine.

The isolated curl machine will now be described according to the figures. FIG. 1 is a perspective view of an exemplary embodiment of the machine. As shown, the machine has a front 144, a back 148, a top 152, and a bottom 156 which will generally be defined by the machine's frame 104. In addition, the machine comprises a seat 108 and an arm rest 112 as well as a resistance assembly 160. The resistance assembly 160 may comprise a resistance device 120 attached to a user-engageable handle 132 by a cable 128. In these embodiments, the resistance device 120 is movable by the user pulling the handle 132. It is noted that any device capable of providing resistance to a user as described herein may be used as a resistance assembly. It will be understood that the method and apparatus disclosed herein may be used to train one or both of a user's biceps as desired.

The frame 104 may be a rigid structure configured to provide support for one or more elements of the machine. For example, various elements of the machine, which will be described further below, may be attached or otherwise secured to the frame 104. It is contemplated that elements may be attached in any suitable way including by one or more mechanical or other fasteners, adhesives, welds, or a combination thereof. One or more of the elements may be integrally formed as part of the frame 104 in one or more embodiments as well.

It will be understood that the frame 104 may be any structure capable of supporting the elements of the isolated curl machine as discussed herein. For example, the frame 104 may comprise a plurality of elongated members such as shown in FIG. 1. These members may be tubes or bars of various shapes. The members may have a square, rectangular, round, or "C" shaped, "I" shaped, or other shaped cross section. The members may be straight along their length or include one or more bends or curves.

The structures which make up the frame 104 need not be elongated members as shown. In some embodiments the frame 104 may comprise one or more planar or other shaped portions such as one or more plates or flat surfaces. As stated, any structure or combination of structures capable of supporting the elements of the isolated curl machine as disclosed herein may be used as a frame 104.

The frame 104 will typically be constructed of one or more rigid materials. Metal such as steel may be used in one or more embodiments. Other materials may be used as well. For example, plastic, wood, composites, carbon fiber, alloys may be used to construct the frame 104 in some embodiments.

In one or more embodiments, the isolated curl machine comprises a seat 108 attached to the frame 104 at the front 144 of the machine. The seat 108 supports the user's body during bicep training and is positioned such that the user may engage the arm rest 112 with at least a portion of his or her arms. In one or more embodiments, the seat 108, arm rest 112, or both may be moved upward, downward, forward, backward, or a combination thereof so that a user may engage the arm rest 112 with at least a portion of the user's upper arms. In this manner, the user is ideally positioned to train his or her bicep muscles.

It is noted that though shown as attached to the remainder of the isolated curl machine, the seat 108 may be separate from the machine in some embodiments. Thus, in some embodiments, a seat 108 may not be required or provided as the user may use an existing seat, a chair, or similar support instead. Also, the seat 108 may not be required in embodiments where the machine is configured to be used while standing. It is noted however that an attached seat 108 provides the advantage of being stationary relative to the remainder of the machine. In this manner, exercises performed on the machine may be safer and more effective.

Figures 3A, 3B, 3C:
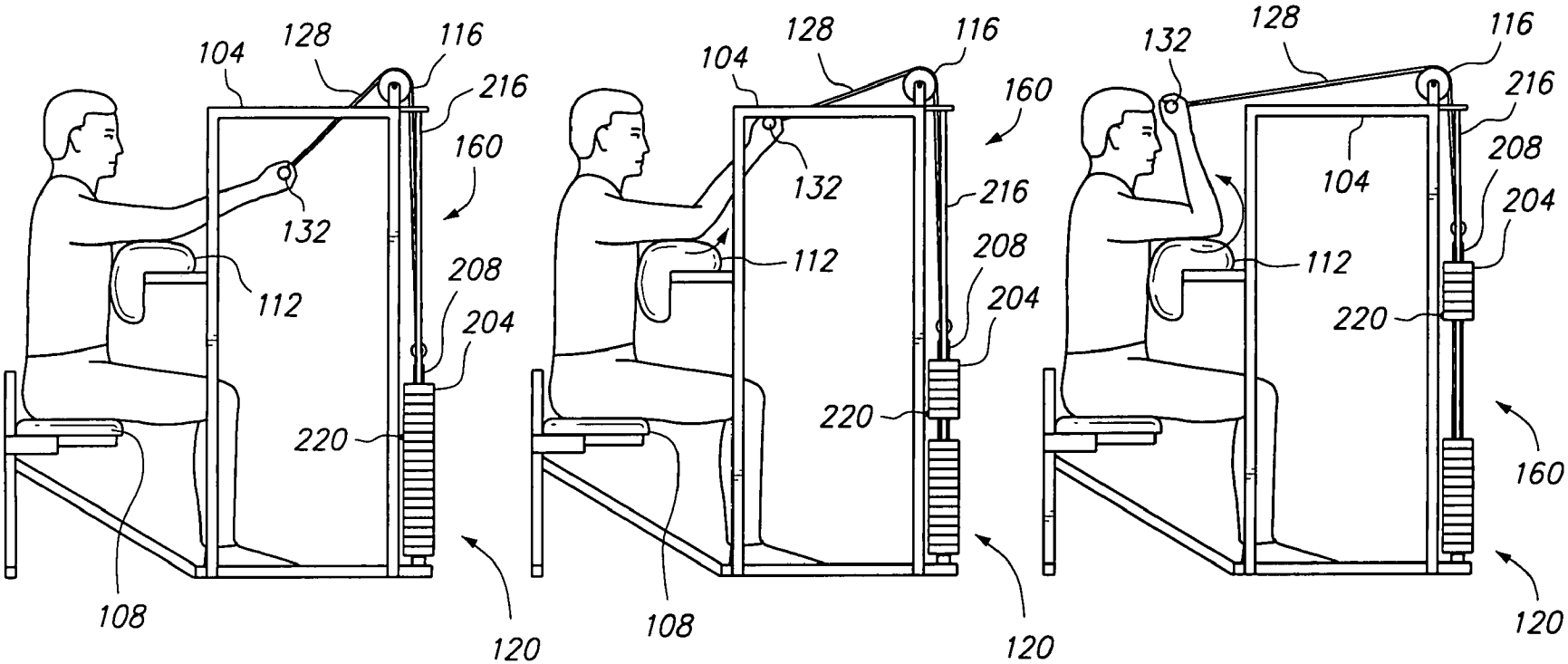
FIGS. 3A-3C is a cross sectional side view illustrating operation of an embodiment of the isolated curl machine.

An arm rest 112 may be located further towards the back of the isolated curl machine relative to the seat 108 in one or more embodiments. The arm rest 112 will generally be located higher than the seat 108 so that the arm rest may support a seated user's arms. Typically, but not always, the arm rest 112 will be positioned near the upper portion of a user's torso such that the user's upper arms may be supported substantially perpendicular to his or her torso as illustrated in FIG. 3A. As will be described below, the arm rest 112 may be adjustable in some embodiments in order to support a user's arms in this manner.

In a standing embodiment of the isolated curl machine (e.g. an embodiment without a seat), the arm rest 112 may be located such that a user's arms may be supported substantially perpendicular to his or her torso while the user is standing. Generally, the arm rest 112 will be located higher in standing embodiments than seated embodiments, such as the seated embodiments described above. It is contemplated that the arm rest 112 may be adjustable such as by being raised or lowered or even tilted to support a user's arms substantially perpendicular to his or her torso. It is further contemplated that the arm rest 112 may be omitted and the system enabled for operation without the arm rest.

The support provided by the arm rest 112 provides the benefit of focusing training on the biceps. To illustrate, in one or more embodiments, at least a portion of the user's upper arms may be supported by the arm rest 112. In this manner, motion is restricted to the user's forearms which are powered by the biceps. Thus, when a resistance is moved by the user's forearms such resistance is focused on the biceps.

As shown, the arm rest 112 is a padded support secured to the frame 104 and having a width sufficient to support both of a user's arms. It is noted that the arm rest 112 may be configured according to various other configurations. For example, the arm rest 112 may be padded or unpadded and may be of various widths. In one embodiment, the arm rest 112 may only be wide enough to support one arm. In addition, multiple arm rests 112 may be provided in one or more embodiments. For example, individual arm rests 112 may be provided for each arm.

It can be seen from the above description that a user may engage the isolated curl machine by sitting on the seat 108 and placing his or her upper arms, or a portion thereof, on the arm rest 112. It is noted that the user may also engage the isolated curl machine by placing his or her upper arms, or a portion thereof, on the arm rest 112 while standing. As shown in FIG. 3A, once in this position, the user may begin training his or her biceps by engaging a resistance assembly 160. Generally, the resistance assembly 160 comprises the elements of the machine which are used to provide resistance to a user to train his or her biceps. With reference to FIG. 1, a resistance assembly 160 may comprise a resistance device 120, a handle 132, a cable 128, and a pulley 116 at the back 148 of the machine. In one or more embodiments, the cable 128 may be supported by a pulley 116 at the top 152 of the machine while the resistance device 120 may be supported by the frame 104 at the bottom 156 of the machine. The pulley and the handle 132 are thus located above the users elbow and arm rest 112. One end of the cable 128 may be attached to a handle 132, while the other end of the cable 128 may be attached to the resistance device 120. A portion of the cable 128 between its ends may be supported by the pulley 116. During a bicep curl, the user may grasp and pull the handle 132 downward toward the user to move the resistance device 120. The pulley 116 translates the force to move the resistance 120 upward.

It is noted that a handle support 136 may be attached to the frame in some embodiments to hold the handle 132 when the machine is not in use. In these embodiments, the handle 132 may be removed from the handle support 136 prior to bicep training. The handle 132 may then be returned to the handle support 136 for storage after training is complete.

Generally, the pulley 116 guides the movement of at least a portion of the cable 128 as it is pulled. As shown, the pulley 116 comprises a wheel configured to accept the cable which turns about an axel; however, pulleys of other configurations may be used. The cable 128 allows the force of the resistance provided by the resistance device 120 to be transferred to a user when the user grasps and pulls the handle 132. In one or more embodiments, the pulley 116 may be positioned (e.g. attached to the frame) such that it is in front of and above the user. As shown in FIG. 1, the pulley 116 is attached at the top 152 and back 148 of the isolated curl machine. In this manner, the pulley 116 rotates and guides the cable 128 upward from the resistance device 120 and then down and towards the user. This is advantageous in that the force vectors of the resistance provided by the resistance device 120 are upward and away from the user thus allowing the user to pull downward to lift the resistance as the user performs a bicep curl.

In fact, user's of the isolated curl machine report that training is more effectively focused on the biceps when compared to traditional machines. In addition, those knowledgeable in the art report that the angle and location of resistance provided by the isolated curl machine provides a type of exercise which will so develop both muscles that a "split" between the two muscles of the biceps will form. It is known that such a split is very difficult to achieve through traditional bicep training methods and devices.

The various configurations of the isolated curl machine disclosed herein provide bicep training but also provide the unexpected result of training the individual muscles of the bicep. In this manner, the isolated curl machine may be used to develop the split described above. As stated, this split is not only difficult to achieve but also highly desirable especially in body building. In one or more embodiments, the location of the pulley at a raised point higher than the elbow and in front of the user provides resistance along a force vector upward and away from the user which is highly beneficial to training the individual muscles of the bicep.

The raised position of the pulley 116 is also beneficial in that it allows the isolated curl machine to accommodate users of varying heights. When positioned high on the frame 104, the pulley 116 will likely be located above most if not all users training on the machine. Thus, short users, tall users, and those in between may enjoy enhanced bicep training on the machine because the resistance transferred to a user by the cable 128 is guided to the user from in front of and above the user, regardless of the user's height.

The raised position of the pulley 116 also allows the isolated curl machine to accommodate users having varying arm lengths. When positioned high on the frame 104, the pulley 116 allows resistance to be provided to a user from above and in front of the user's arms during a bicep curl, regardless of the length of the user's arms.

Of course, the pulley 116 may be positioned at various locations in one or more embodiments. For example, the pulley 116 may be positioned in front of and at least above a user's shoulders to allow the resistance to be transferred to the user by the cable 128 from a raised point in front of the user. It is noted that the pulley 116 may be positioned lower however this may result in the cable 128 and thus the resistance becoming more horizontal. This generally reduces the upward force provided by the resistance and thus may reduce the effectiveness of bicep training on the machine.

Figure 2A:
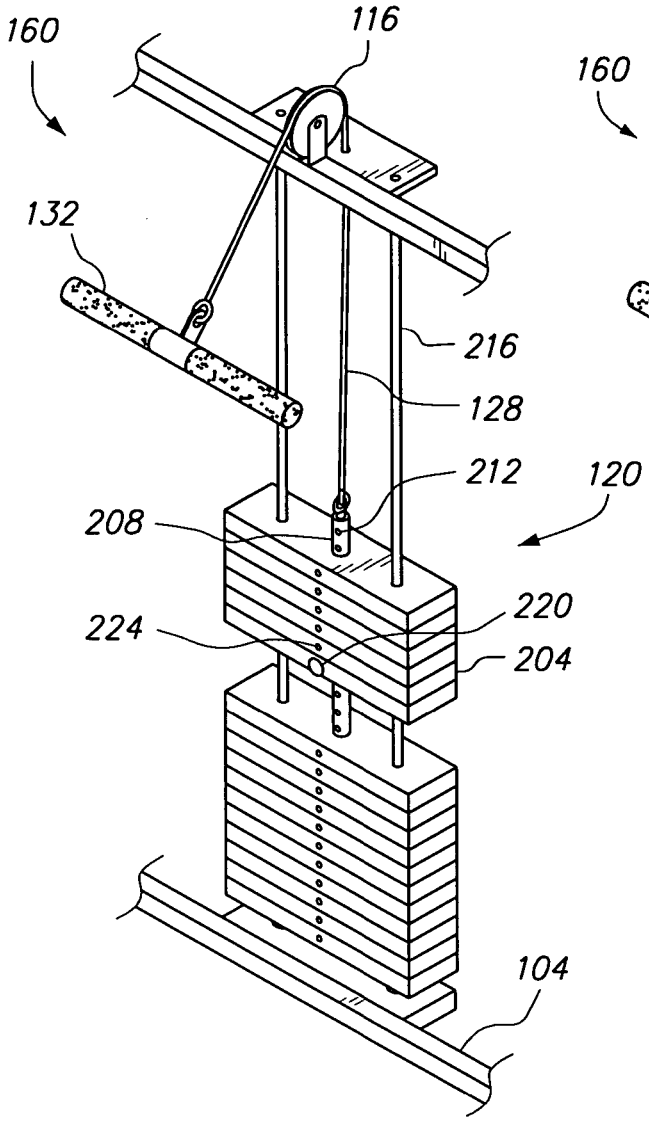
FIG. 2A is a perspective view of an exemplary embodiment of a resistance assembly of the isolated curl machine.

Various types and configurations of resistance assemblies 160 having one or more resistance devices 120 may be provided. For example, as shown in FIG. 2A, a weight stack may be used as a resistance device 120. In this embodiment, the resistance device 120 may comprise one or more individual weights 204, a lifting rod 208, and one or more guides 216. The lifting rod 208 allows one or more individual weights 204 to be attached thereto. For example, the lifting rod 208 may include a series of holes 212 along its length and the weights 204 may include one or more openings 224 that may be aligned with the holes of the lifting rod. In this manner, a securing pin 220 may be inserted through an opening 224 of a weight 204 and into a hole 212 on the lifting rod 208 to secure the weight to the lifting rod. The securing pin 220 may be repositioned along the length of the lifting rod 208 to secure more or less weight to the lifting rod 208 thus adjusting the resistance provided. As shown in FIG. 2A, a single securing pin 220 may secure a plurality of weights 204. Of course, multiple securing pins 220 may be used if desired. The weights 204 that are not secured to the lifting rod 204 may remain stationary during bicep exercise and thus do not affect the resistance provided to the user.

The lifting rod 204 may be connected to the end of the cable 128 opposite the end of the cable where the handle 132 is attached. In this manner, pulling the handle 132 pulls the cable 128 and lifting rod 208 and the weights 204 attached thereto. One or more guides 216 may be used to guide the movement of the weights 204 as they are moved. The guides 216 may comprise rigid bars or the like which run through the one or more weights 204 of the resistance device 120. In this manner, the weights 204 may move along the guides 216. Guides 216 are beneficial in that they prevent the weights 204 from swinging as they move during a bicep curl. However, it is noted that some embodiments may not include guides 216 such as where movement of the weights 204 is already suitably restricted by other structures or by the configuration of the resistance device 120. For example, planer or other shaped members which at least partially surround the weights 204. In one embodiment, these members could be placed adjacent one or more sides of the weights 204. In this manner, swinging or other undesired movement would be prevented by the members adjacent or partially surrounding the weights 204. In another exemplary embodiment, the one or more weights 204 may be attached to a track to prevent undesired movement.

Figure 2B:
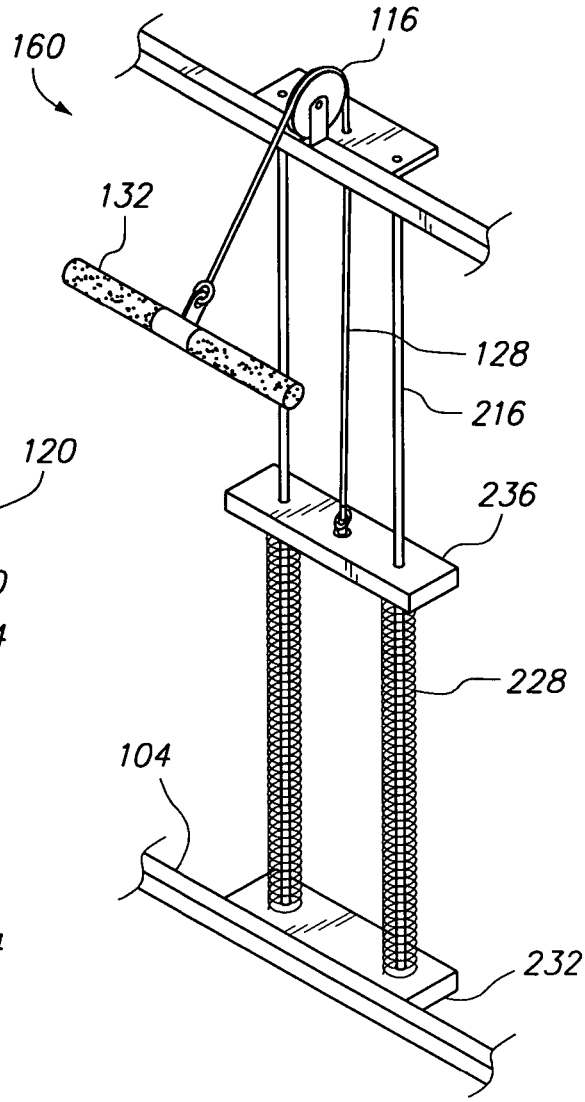
FIG. 2B is a perspective view of another exemplary embodiment of a resistance assembly of the isolated curl machine.

FIG. 2B illustrates another embodiment of a resistance device 120. In this embodiment, resistance is provided by one or more springs 228 rather than weights. Springs 228 provide the benefit of variable resistance which allows resistance to increase or decrease as the springs are stretched. During a bicep curl, a user's arms are generally capable of exerting more power as they move closer to the user's body. Thus, a variable resistance is beneficial because the variable resistance may correspondingly increase as the user's arms move closer to the body. In addition, a variable resistance may provide a decreased resistance when the arms are extended and more prone to injury due to their extended position. The variable resistance may then increase as the arms are moved towards the body during a bicep curl.

In the embodiment of FIG. 2B, the resistance device 120 comprises two springs 228, a lifting mount 236, and a frame mount 232. It is noted that some embodiments may utilize a single spring 228 or more than two springs. In addition, though described generally with regard to springs 228, it is contemplated that other variable resistance generators such as elastic cords and the like may be used in addition to or instead of a spring to provide variable resistance.

The lifting mount 236 and frame mount 232 provide structures to which the ends of the springs 228 may be secured. The springs 228 may be permanently attached to these mounts by one or more welds. Alternatively, the springs 228 may be removably attached to these mounts. For example, the mounts may comprise one or more eyelets or loops which engage hooks on the springs 228, or vice versa. Removable attachment allows the amount of resistance provided by the resistance device 120 to be changed. For example, additional springs 228 may be added or one or more springs may be replaced with stronger or weaker springs as desired. It is contemplated that any fastener, structure, adhesive, or the like that is capable of securing the springs may be used as a lifting mount 236 or frame mount 232.

As shown in FIG. 2B, the lifting mount 236 includes a plate-like or planar structure. This provides an area to which the cable 128 may be attached. In addition, this provides an area to accommodate two or more springs 228. Without this area, the springs 228 may not be spaced sufficiently apart and thus become entangled. Furthermore, the planar structure may provide guide holes which allow one or more guides 216 to pass therethrough to guide the movement of the lifting mount 236 and the springs 228 as they are moved during exercise. Without the guides 216 and guide holes, the springs 228 may swing about when moved during training. It is contemplated that other structures may be used to guide the movement of the lifting mount 236 and springs 228 in one or more embodiments. For example, the lifting mount 236 may be attached to a track or be located within an open or closed vertical channel. Guides 216 and guide holes may not be required in all embodiments, as the springs 228 may be suitable stable without them.

The frame mount 232 may also include a planer structure if desired, such as for example, to provide sufficient area to allow two or more springs 228 to be used. Typically, the frame mount 232 will be attached to the frame 104 at the bottom 156 of the machine. It is noted that a planar structure may not be provided in all embodiments because one or more frame mounts 232 may be directly attached to the frame 104 at varying spaced intervals.

Other resistance devices 120 may be used with the isolated curl machine as well, including but not limited to, rotating or friction based resistance devices. As will be discussed above, the cable 128 and pulley 116 orient the resistance provided by a resistance device 120 so that the user experiences the force of the resistance from in front of and above the user. Thus, any resistance device 120 to which the cable 128 may be attached may be used with the machine. Also, it is noted that one or more additional pulleys 116 may be used to guide the cable 128 such that it properly attaches to a resistance device 120. In general, proper attachment means attaching the cable 128 to a resistance device 120 such that the resistance provided by the resistance device may be efficiently transferred along the cable 128 to the user. To illustrate, in FIGS. 2A and 2B, a pulley 116 is used to guide the cable 128 such that a portion of the cable attaches to the top of the lifting rod 208 or lifting mount 236 respectively.

Elements of the isolated curl machine may be adjustable in one or more embodiments. For example, the seat 108 or arm rest 112 may be adjustable to accommodate various users. As stated, a user generally engages the machine by sitting on the seat 108 and placing or resting a portion of his or her upper arms on the arm rest 112. Thus, the seat 108 may be raised or lowered to allow a user to engage the machine with a safe and proper body posture. The arm rest 112 rather than the seat 108 may also or alternatively be raised or lowered to allow the user to engage the machine. In one embodiment, the seat 108, the arm rest 112, or both may be raised, lowered, or both so that a seated user's arms are supported such that they are substantially perpendicular to the user's torso.

The arm rest 112 may be adjusted in other ways as well. The angle at which the arm rest 112 is positioned may be rotated such that the user's upper arms are supported at various angles as desired. Generally, the user's upper arms will be supported such that they are perpendicular to the user's torso. However, the arm rest 112 may be adjusted or tilted to support the upper arms and different angles if desired. For example, the arm rest 112 may be tiled forward or backward to support the uppers arms at different angles. It is noted that the arm rest 112 may be tiled left or right in some embodiments such as to increase or decrease the height of one arm relative to the user's other arm.

In addition, an arm rest 112 maybe adjusted by moving the arm rest left or right on the isolated curl machine relative to the user. In this manner, the arm rest 112 may be adjusted to support the only the left arm or the right arm. Where a plurality of arm rests 112 are provided, each arm rest may be moved left or right so that the arms may be positioned closer or further apart during bicep training. This is advantageous in that users of different sizes may use the machine comfortably. Of course, as stated, a single arm rest 112 may be configured such that it is wide enough so that left or right adjustment is not required.

Operation of the isolated curl machine will now be described with regard to FIGS. 3A-3C. These figures illustrate a user performing a bicep curl on the machine. A cross-sectional view of the machine is provided to better illustrate its operation. As will be described further below and as shown in these figures, the resistance provided to a user is in front of and above the user. Though described with regard to one embodiment of the machine, it will be understood that other embodiments of the machine, such as those disclosed herein, may operate in like manner. In addition, though described regarding both of a user's arms, bicep training may take place on a single arm or on both arms simultaneously on the machine.

In FIG. 3A, a user has engaged the machine by sitting on the seat 108 and placing or resting his or her upper arms on the arm rest 112. The user has also engaged the resistance assembly 160 by extending his or her arms and grasping a handle 132 of the assembly. As shown, the user's upper arms are supported such that they are substantially perpendicular to the user's torso. This will generally be known as the initial or starting position of a bicep curl on the machine.

It can be seen that a cable 128 is attached to the resistance device 120 on one end while attached to the handle 132 on the other end. The force of the resistance provided by the resistance device 120 is thus transferred along the cable 128. The cable 128 is guided by a pulley 116 at the top of the machine such that the cable runs upward from the resistance device 120 and down and towards the user. Thus, as shown, the force of the resistance is upward and away from the user.

The user has adjusted the resistance device 120 to provide the desired amount of resistance. In FIG. 3A, the user has inserted a securing pin 220 on the fourth weight 204 of the weight stack to select the desired amount of resistance. In other embodiments, such as an embodiment having a variable resistance, the user may add, remove, or replace, one or more springs or the like to achieve the desired amount of resistance. It is noted that the amount of resistance provided by the isolated curl machine may be adjusted at any time.

In this embodiment, the user experiences little or no resistance in the initial position. As can be seen, the resistance provided by the resistance device 120 has not been moved. Of course, in some embodiments, the machine may be configured such that the user must move a resistance to get into the initial position. For example, in these embodiments, the user must grasp and pull the resistance via the handle 132 at least slightly to get into the initial position.

In FIG. 3B, the user has pulled the handle 132 towards his or her body. This has pulled the attached cable 128 and weights 204 of the resistance assembly. Thus, the user has moved the resistance provided by the resistance device 120 by pulling the handle 132. As can be seen, the pulling motion is accomplished by applying the strength of the user's biceps to bend the user's arms at their elbows. This is illustrated by the arrow in FIG. 3B. The user's upper arms are supported by the arm rest 112 and thus the user's effort or strength is concentrated at the biceps when the user pulls the handle 132. In this manner, the user raises the upper four weights 204 of the resistance device 120 which have been secured to the cable 128 by a lifting bar 208 and a securing pin 220 inserted into the lifting bar. It can also be seen from FIG. 3B that as the handle 132 is pulled, the cable 128 is guided by the pulley 116 such that the force of the resistance remains upward and away from the user.

In FIG. 3C, the user continues to pull the handle 132 towards his or her body to an end position. The end position generally defines the end of the pulling portion of a single bicep curl. Once the handle 132 has been pulled by the user's arms to the end position the user may reduce his or her pulling force to allow the handle and his or her arms to return to the initial position.

The force of the resistance will return the handle 132 to its initial position as illustrated in FIG. 3A. Thus, the user may continue to train his or her biceps when returning to the initial position by slowing the return of the handle 132 to its initial position. To illustrate, the user may exert a force through his or her biceps to slow the return of the handle 132. As the handle 132 returns the attached cable 128 and weight 204 or other resistance also return to their initial positions so that another bicep curl may be performed. The force of the resistance during the return to the initial position remains upward and away from the user in this embodiment.

It is contemplated that the operation of the isolated curl machine described with regard to FIGS. 3A-3C will typically occur in a continuous motion from the initial position to the end position. The user may pause or hold the end position for a time and then return, in a continuous motion, from the end position back to the initial position. The user may perform one or more bicep curl repetitions as desired or according to one or more training routines or guidelines.

As stated, the force of the resistance provided by the resistance device is guided by the isolated curl machine's pulley such that the force is pointed upward and away from the user. Thus, during a bicep curl, the user's biceps must overcome this force by applying an opposite force. Traditional bicep curls utilize a downward force which does not provide training as effective as the force provided by the isolated curl machine.

In addition, the isolated curl machine provides a generally horizontal arm support which supports the upper arms substantially perpendicular from the user's torso in one or more embodiments. This is distinct from traditional curl machines such as preacher curl machines which provide an angled support of the upper arms where the upper arms are supported such that they point downward.

As is known, each bicep has two muscles and achieving definition between these two muscles is difficult to obtain and highly desirable in the art. The unique aspects, such as the unique resistance and arm support just described, of the isolated curl machine allow the machine to provide bicep training and make the machine ideally suited to allow a user to achieve increased muscle definition of the biceps. It is specifically contemplated that the machine may be used to develop definition between the two muscles of each bicep because of the unique resistance and arm support provided by the machine as discussed herein.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A method for bicep training at an isolated curl machine, the isolated curl machine comprising an arm rest and a resistance assembly, whereby the resistance assembly provides a resistance having a force vector directed upward and away from a user via a cable, the method comprising:

resting at least one arm on the arm rest, wherein the elbow of the at least one arm is lower than a pulley of the resistance assembly;

extending the at least one arm and grasping the handle to establish the at least one arm at an initial position; and moving the at least one arm from an initial position to an end position of a bicep curl while grasping the handle of the resistance assembly, wherein moving the at least one arm pulls the handle downward toward the user to overcome the resistance, the resistance having a force vector directed upward and away from the user.

2. The method of bicep training of claim 1 further comprising moving the at least one arm from the end position to the initial position of the bicep curl while grasping the handle of the resistance assembly.

3. The method of bicep training of claim 1 further comprising sitting on a seat of the isolated curl machine prior to extending the at least one arm and grasping the handle.

4. The method of bicep training of claim 1, wherein the resistance assembly comprises:

a resistance device configured to provide the resistance;

a handle;

a cable having a first end and a second end and configured to transfer the resistance provided by the resistance device to a user, the cable attached to the handle at the first end and attached to the resistance device at the second end; and a pulley configured to guide the first end of the cable downward toward the user.

5. The method of bicep training of claim 1, wherein the resistance device is a weight stack.

6. The method of bicep training of claim 1, wherein the resistance device comprises a variable resistance generator.

* * * * *